United States Patent [19]

Schroer

[11] Patent Number: 4,545,098

[45] Date of Patent: Oct. 8, 1985

[54] PIN OR CLIP CHAIN FOR WEB TENSIONING OR STRETCHING MACHINES

[75] Inventor: Franz-Josef Schroer, Erkelenz, Fed. Rep. of Germany

[73] Assignee: A. Monforts GmbH & Co., Monchen-Gladbach, Fed. Rep. of Germany

[21] Appl. No.: 431,636

[22] Filed: Sep. 30, 1982

[30] Foreign Application Priority Data

Sep. 30, 1981 [DE] Fed. Rep. of Germany ..... 3138777

[51] Int. Cl.[4] ..... D06C 3/10

[52] U.S. Cl. ..... 26/89; 59/85; 198/851; 474/227

[58] Field of Search ..... 26/89, 93, 95, 96; 59/84, 85; 198/851; 474/227

[56] References Cited

U.S. PATENT DOCUMENTS

| | | | |
|---|---|---|---|
| 254,739 | 3/1882 | Wallis | 474/227 |
| 2,915,909 | 12/1959 | Boron | 59/84 X |
| 3,234,621 | 2/1966 | Hyatt | 26/93 |
| 4,198,814 | 4/1980 | Schoenick | 474/227 X |

FOREIGN PATENT DOCUMENTS

| | | | |
|---|---|---|---|
| 1965445 | 12/1970 | Fed. Rep. of Germany | 59/84 |
| 1965395 | 1/1971 | Fed. Rep. of Germany | 59/84 |
| 913844 | 6/1946 | France | 474/227 |
| 211802 | 3/1967 | Sweden | 198/851 |
| 445360 | 8/1982 | U.S.S.R. | 59/85 |

*Primary Examiner*—Robert R. Mackey

*Attorney, Agent, or Firm*—Herbert L. Lerner; Laurence A. Greenberg

[57] ABSTRACT

Pin or clip chain for web tensioning machines, including a pin or clip chain link, a connection chain link, a connection pin holding the links together, the pin or clip chain link having a C-shaped box section with a side disposed in a given plane having an opening formed therein and longitudinal ends, and a bearing half shell being disposed in each of the longitudinal ends of the C-shaped box section, the bearing half shells having axes extended perpendicular to the plane of the side of the C-shaped box section, the connection pin being insertable in the opening formed in the C-shaped box section.

10 Claims, 3 Drawing Figures

PIN OR CLIP CHAIN FOR WEB TENSIONING OR STRETCHING MACHINES

The invention relates to a pin or clip chain for web stretching or tensioning machines, including chain links which are held together by connection pins. In the chain, a pin or clip chain link alternates with a connection chain link.

Such a chain of pin or clip chain elements for web stretching machines, formed in particular of clamp or clip bodies with connecting links positioned inbetween, with chain section parts which are C-shaped and have fork-like bearing supports for the junction pins and associated connection links, are described in German Pat. No. DE-PS 947 460. The joint pins necessary for this chain require regularly repeated lubrication. This lubrication requires time, and if the machine is continuously operated through three shifts, this causes a considerable loss in work output. If the chain is damaged, the exchange of one link is very cumbersome, because the complicated removal of one of the joint pins which connect the chain links, is required.

A tensioning chain which can be easily taken apart is known from German Published Prosecuted Application No. DE-AS 14 60 733. This tensioning chain has plate-like chain links with front ends that are bent toward each other. The bent ends of adjacent chain links engage each other in a hook like manner. Tensioning chains of this type are mainly provided for conveying fabric webs through a liquid. However, these chains are not suited for conventional web tensioning machines in which the web is treated from one or both sides with a gas, because they lack exact guiding in a guide track, and because of their instability.

It is accordingly an object of the invention to provide a pin or clip chain for web tensioning or stretching machines, which overcome the hereinafore-mentioned disadvantages of the heretofore-known devices of this general type, and to provide a pin or clip chain which can be operated through three shifts with practically no maintenance in a web stretching machine, over a period of one year.

With the foregoing and other objects in view there is provided, in accordance with the invention, a pin or clip chain for web tensioning machines, including a pin or clip chain link, a connection chain link, a connection pin holding the links together, the pin or clip chain link having a C-shaped box section with a side disposed in a given plane having an opening formed therein and longitudinal ends, and a bearing half shell being disposed in each of the longitudinal ends of the C-shaped box section, the bearing half shell having axes extended perpendicular to the plane of the side of the C-shaped box section, the connection pin being insertible in the opening formed in the C-shaped box section. In this way, the invention creates a pin or clip chain which does not include any rotating parts, and which therefore does not require lubrication. The chain links are under straight tension on the essentially straight path through the heated interior of the machine, so that there is only very little motion between the pins and the bearing half-shells. The bearing half-shells preferably are formed of a wear-proof, friction reducing material, such as bearing bronze or polytetrafluorethylene. If synthetic polytetrafluorethylene is used, there is no danger that the material will yield, inspite of the increased operating temperature, because the half-shell is rigidly supported everywhere (except on the bearing surface). Since the diameter of the pin in the bearing half-shell is about 1 to 2 cm, the contact area between the bearing half-shell and the connection pin is large enough for a practically wear and maintenance free operation for a long period of time.

In accordance with another feature of the invention, the connection pin is fixed to the connection chain link.

In accordance with a further feature of the invention, the connection chain link is solid and has two mutally parallel outer surfaces, one of the surfaces being connected to the connection pin, and including a deflection pin attached to the other of the surfaces opposite the surface connected to the connection pin, for guiding the chain over chain wheels at longitudinal ends of the web tensioning machine.

In accordance with an added feature of the invention, the C-shaped box section is completely closed and solid about the periphery thereof beyond the opening formed therein. To allow a maintenance-free guiding of the chain in a chain guide, especially in a chain guide-housing in a web-tensioning machine, in accordance with an additional feature of the invention, the connection chain link is formed of a wear resistant material with a low friction coefficient.

In accordance with yet another feature of the invention, the connection chain link is formed of bearing bronze.

Additionally, or as an alternate, it can be advantageous, if the contact surfaces of the two chain links which during the operation of the chain are exposed to friction at the surfaces of the chain guide or housing or some other parts of the chain guide, are reinforced or at least partly covered with the wear resistant material. Therefore, in accordance with yet a further feature of the invention, the links have surfaces for sliding along surfaces of a chain housing during operation, and including wear resistant material with a low friction coefficient at least partially coating the surfaces of at least one of the links.

In accordance with yet an added feature of the invention, the wear resistant material is chosen from the group consisting of bearing bronze and polytetrafluorethylene.

It is especially advantageous, if the two chain links are constructed in such a manner that friction reducing elements are integrated in the construction of the chain links. Therefore, in accordance with still another feature of the invention, there are provided slide elements integral with the pin or clip chain link, the connection chain link being wear resistant and friction reducing for guiding on a chain guiding housing. In any case, the friction reducing sliding elements at the friction surfaces should be made strong enough that even during continuous operation of the chain through three shifts, an exchange of the sliding elements is only required after one year, or preferably after two years.

An additional advantage of the pin or clip chain is its easy installation and its easy removal. For example, it is possible to exchange a chain link with very little manipulation. For this prupose, in accordance with a concomitant feature of the invention, the C-shaped box section is closed in the longitudinal direction beyond the opening formed therein and adjacent the bearing half-shells, and the C-shaped box section having an expanded middle region between the longitudinal ends thereof permitting insertion and removal of the connection pin, the connection pin beng attached to the connection chain link and having a cylindrical head fitted to the bearing half-shells, and said connection pin having a neck formed therein between the cylindrical head and the connection chain link being freely mobile in the opening formed in the side of the C-shaped box section. In this way, the C-shaped box section can be formed by bending from a flat metal piece, but it can also be made from a four-corner hollow profile with a suitable cutout at the open side thereof. In the case of using a cutout, it is especially advantageous for the stability of the part if the complete box section is solidly closed at the longitudinal ends at the periphery thereof. Depending on what sides of the C-shaped box section the respective pin or clip chain is attached by a suitable clamp, the chain can be operated with otherwise unchanged parts and with horizontal or vertical deflection on chain wheels which are, preferably, disposed outside the machine. The means for deflection of the endless chain at the end of the chain track can be constructed as toothed wheels or sprockets, which engage the deflection pins that are provided opposite the connection pins which engage in the C-shaped box section at the connection chain links. To reduce the friction between the deflection pins and the deflection wheel, the deflection wheel can have rotatable rollers at its periphery instead of teeth which engage the deflection pins. These rotatable rollers can run in lubricated bearings which are practically maintenance free, because they are outside the heated interior of the machine.

Other features which are considered as characteristic for the invention are set forth in the appended claims.

Although the invention is illustrated and described herein as embodied in a pin or clip chain for web tensioning or stretching machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
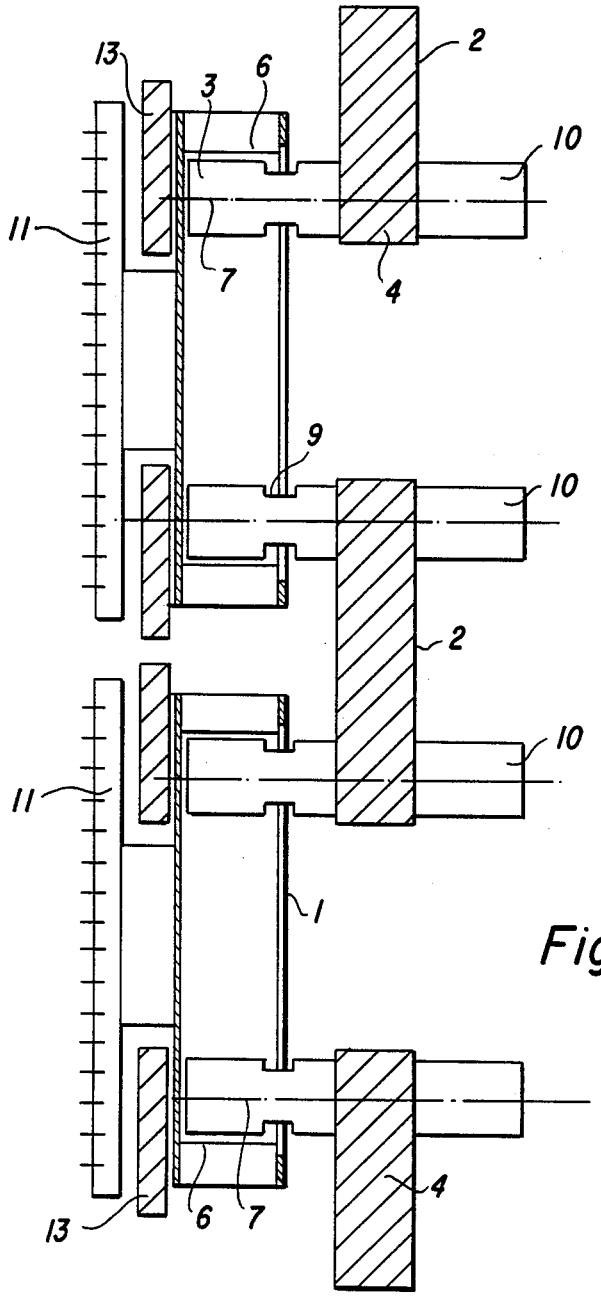
FIG. 1 is a diagrammatic, cross-sectional plan view of a chain, as seen perpendicular to the axes of the chain-joints.

Referring to the three figures of the drawing as a whole, it is seen that they relate to a chain of needles. The chain of needles includes needle or clip chain links which are all designated by reference numeral 1, and connection chain links which are all designated by reference numeral 2. The needle-chain links 1 and the connection-chain links 2 are held together by connecting pins 3, which are in a fixed connection with an essentially square solid shape of the respective connection link 2. The needle-chain link 1 is provided with a C-shaped box section 5, which is shown in a plan view in FIG. 2 and in a cross section in FIG. 3. A bearing half-shell 6 is introduced into the end regions of each C-shaped box in such a manner that the axis 7 of the bearing half-shell 6 is oriented perpendicular to the plane formed by the open side of the C-shaped box 5. The connecting pins 3 of the connection-chain links 2 are formed in such a way with respect to their diameter and length, that they exactly fit the bearing half-shells 6. While the pins 3 may be made of steel or corrosion-free stainless steel, in order to accomplish the objectives of the invention, the bearing half-shells are made from a relatively wear-resistance material with a low friction coefficient, so that special lubrication is not required for the operation of the chain.

The opening 8 of the C-shaped box 5 of the needle-chain link 1 is widened in the middle between the bearing half-shells, so that the insertion or the removal of the connection pin 3 does not present any difficulties. On the other hand, to prevent the connetion pin 3 from slipping out of its connection with the bearing half-shell when the chain is operated, the pin 3 is provided with a neck 9 below its cylindrical head, which is engaged in the bearing half-shells 6 or in the region adjacent the connection-chain link 2. Furthermore, the C-shaped box section 5 is to be closed in its longitudinal direction adjacent the bearing shells 6 except for a gap which just permits the free mobility of the neck 9.

Figure 2:
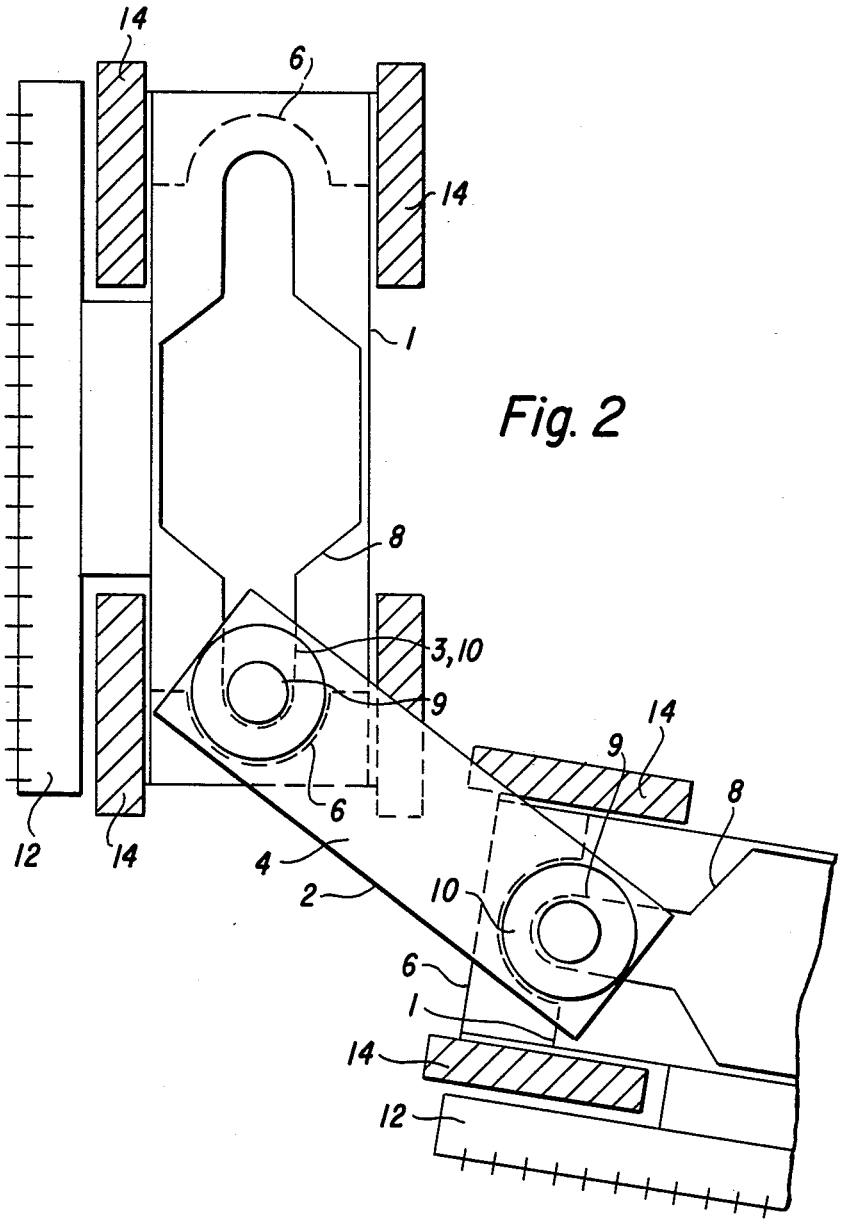
FIG. 2 is a partially cross-sectional view of another embodiment of a chain, as seen parallel to the axes of the chain-joints.
Figure 3:
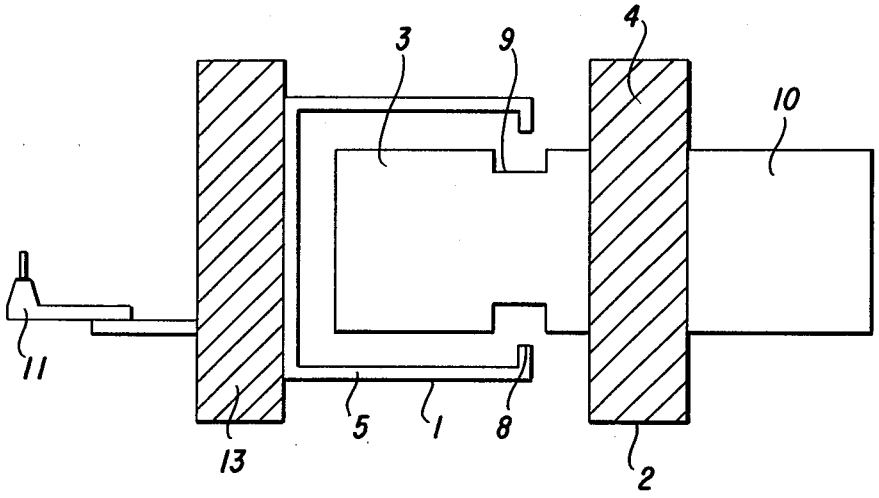
FIG. 3 is a cross-sectional view as seen through a box-profile with the connection chain link.

The shape of the opening 8 of the C-shaped box section 5 is in principle shown in FIG. 2. As shown, the diameter of the connection pin 3 is dimensioned in such a way that the pin can be inserted in the central region of the opening 8 without difficulties, or it can be removed without problems. However, the head cannot slip out from the C-shaped box section 5 in the region adjacent the half-shell 6 in the direction of the axis 7 of the half-shell 6. The connection between the needle-chain link 1 and the connection-chain link 2 caused by the C-shaped box section 5 and the respective connection pin 3 according to the invention, is constructed in such a way that an unexpected disengagement of the chain links cannot occur during operation, i.e. when there is tension in the longitudinal direction. However, if the chain is relaxed, the chain can be easily opened, such as by unhooking, and in this manner a chain link can be exchanged manually with ease.

The chain is guided over horizontally or vertically supported deflection wheels at the ends of its essentially straight route through the fabric tensioning machine. Deflection wheels can engage the chain at deflection pins 10, which are provided at the connection pins 3 that engage in the C-shaped box section 5 on the outer surface of their solid shape 4. It serves the purpose of the invention to always position the deflection pins 10 and the connection pins at the same axis of the connection chain links 2. The elements 3 and 10 may be one piece or two interconnected pieces.

The chain, according to the invention, can be deflected horizontally as well as vertically. Essential changes of the chain links 1 and 2 are not required. Only the web edge retaining bars 11, 12 which may be a clip or needle bar are connected with the outer surface which lies opposite the opening 8 of the C-shaped profile section 5 during the vertical deflection of the chain. Meanwhile, during a horizontal deflection, the needle bars are connected to an outer surface which is adjacent the opening 8 of the C-shaped box profile 5.

To reduce the wear and friction force of the chain with respect to the chain guide or chain guide housing, friction surfaces (gluide elements) are provided at different surfaces of the chain links, depending on whether or not the chain links are used for horizontal or vertical chains. For example, in the vertically deflected chain embodiment according to FIG. 1, friction elments 13 are provided at the surface of the C-shaped box section 5 which is turned toward the needle bar 11. The friction elements 13 must, therefore, be shaped in such a way that they protect the C-shaped box profile 5 from touching the respective guide provisioins. It is also possible to construct the whole solid shape 4 of the connection chain links 2 as sliding elements. In both cases, a wear resistant material with a low friction coefficient is satisfactory for making the sliding elements. For the horizontally deflected chain embodiment according to FIG. 2, the friction elements 14 (sliding elements) can be provided on both sides of the C-shaped box profile 5, which are adjacent the surface with the opening 8. In this case as well, the sliding elements 14 should be constructed, especially at the bottom (with respect to the drawing), in such a way that they project so that a touching of the C-shaped box section 5 with the chain guiding means cannot occur.

I claim:

1. A chain for a web tensioning machine, comprising a plurality of chain links, a plurality of connection chain links, a plurality of connection pins, each respective connection pin holding one of said chain links and one of said connection chain links together forming units of a complete chain, in each unit said chain link having a C-shaped box section with a side disposed in a given plane having an opening formed therein and longitudinal ends, a bearing half-shell being disposed in each of said longtitudinal ends of said C-shaped box section, and a web edge retaining bar connected to said chain link for retaining a web, said bearing half-shells having axes extended perpendicular to said plane formed by said open side of said C-shaped box section, and said connection pin being fixed to said connection chain link and insertible in said opening formed in said C-shaped box section to engage one of said bearing half-shells and means on said connection pin to prevent disengagement of said links during operation of the machine.

2. Chain according to claim 1, wherein said connection chain link is solid and has two mutually parallel outer surfaces, one of said surfaces being connected to said connection pin, and including a deflection pin attached to the other of said surfaces opposite said surface connected to said connection pin, for guiding the chain over chain wheels at longitudinal ends of the web tensioning machine.

3. Chain according to claim 1, wherein said C-shaped box section is closed in the longitudinal direction beyond said opening formed therein and adjacent said bearing half shells, and said C-shaped box section having an expanded middle region between said longitudinal ends thereof permitting insertion and removal of said connection pin, said connection pin being attached to said connection chain link and having a cylindrical head fitted to said bearing half shells, and said means to prevent disengagement of said links during operation comprises a neck formed in the connection pin between said cylindrical head and said connection chain link being freely mobile in said opening formed in said side of said C-shaped box section.

4. Chain according to claim 1, wherein said C-shaped box section is completely closed and solid about the periphery thereof beyond said opening formed therein.

5. Chain according to claim 1, wherein said connection chain link is formed of a wear resistant material with a low friction coefficient.

6. Chain according to claim 5, wherein said connection chain link is formed of bearing bronze.

7. Chain according to claim 1, wherein said links have surfaces for sliding along surfaces of a chain housing during operation, and including wear resistance material with a low friction coefficient at least partially coating said surfaces of at least one of said links.

8. Chain according to claim 7, wherein said wear resistant material is formed of bearing bronze.

9. Chain according to claim 7, wherein said wear resistant material is formed of polytetrafluorethylene.

10. Chain according to claim 1, including slide elements integral with said chain link, said connection chain link being wear resistant and friction reducing for guiding on a chain guiding housing.

* * * * *